United States Patent [19]

Larrow

[11] 4,071,984

[45] Feb. 7, 1978

[54] HOUSE ASSEMBLY WITH PREFABRICATED ELEMENTS

[76] Inventor: Kenneth Larrow, 13100 Belcher Road, Largo, Fla. 33540

[21] Appl. No.: 723,809

[22] Filed: Sept. 16, 1976

[51] Int. Cl.[2] ..... E04C 1/00

[52] U.S. Cl. ..... 52/79.1; 52/309.4; 52/309.14; 52/495

[58] Field of Search ..... 52/309, 404, 405, 406, 52/743, 747, 745, 79, 495, 309.1, 79.1, 79.12, 309.4, 309.14

[56] References Cited

U.S. PATENT DOCUMENTS

| | | | |
|---|---|---|---|
| 3,236,014 | 2/1966 | Edgar | 52/404 |
| 3,381,432 | 5/1968 | Brandwein | 52/309 |
| 3,407,555 | 10/1968 | Pugh | 52/495 X |
| 3,423,891 | 1/1969 | Burris | 52/495 X |
| 3,462,897 | 8/1969 | Weinrott | 52/309 |
| 3,859,401 | 1/1975 | Gallap et al. | 52/309 X |
| 3,975,876 | 8/1976 | Sauder | 52/495 X |

*Primary Examiner*—J. Karl Bell
*Attorney, Agent, or Firm*—Stein & Frijouf

[57] ABSTRACT

The building or house assembly elements disclosed herein comprise prefabricated wall panels and linearly grooved vertical studs or pillars or horizontal joists into which the edges of these wall panels are fitted and supported. The wall panels comprise a laminated structure with a thick interior section of insulation such as foam polystyrene, foam polyurethane, fiberglass, etc. with outer surfaces comprising wood, aluminum, plastic, etc. which is laminated to the insulation material. The overall width of the laminated panel is of the same dimension as the width of the grooves in the pillars or joists so as to fit tightly therein. Each panel has a substantial length so that generally no more than two panels are sufficient to fill the full length of said linear groove. The structure of this invention is particularly adaptable to the inclusion of windows and doors in the structure. These are built into the structure by inserting splines into the grooves in the pillars or joists and fastening the windows and doors thereto. The design of this structure provides for quick, easy and secure construction of durable and sound building structures. Other advantages are ease of shipment due to light weight, ease of erection, since no one unit needs more than two persons to erect, economy of operation of the finished structure due to the highly insulative nature of the foam cored insulated wall and roof panels. Member sizes are kept to such lengths as to make it possible to palletize and containerize an entire structure for shipment on any export basis.

14 Claims, 17 Drawing Figures

HOUSE ASSEMBLY WITH PREFABRICATED ELEMENTS

BACKGROUND OF THE INVENTION

1. Field of the Invention

This invention relates to prefabricated panels, and grooved pillars and joists for assembling and supporting these panels in the construction of buildings, such as houses, etc. More specifically it relates to a type of prefabricated construction which permits the easy construction of windows and doors in walls constructed from such panels, pillars and joints.

2. State of the Prior Art

Various patents have been granted on the construction of buildings with prefabricated wall elements such as U.S. Pat. Nos. 3,339,327; 3,369,335; 3,080,674; 3,810,340; 3,350,824 and 3,757,485. However, these involve rather complicated and cumbersome assemblies. Moreover, these types of construction are not easily adaptable for the inclusion of doors and windows in the various wall sections.

It is an object of this invention therefore to provide a simple design structure, easy to manufacture and easy to assemble into a building. It is also an object of this invention to provide an easy and simple method of including windows and doors in the wall structures of this invention.

STATEMENT OF THE INVENTION

In accordance with the present invention, prefabricated elements have been designed for the easy assembly into buildings to provide economical, sound and very efficient construction. This design comprises panels having an inner core of an insulating material such as foam polystyrene, foam polyurethane, fiberglass, foam concrete, or other substantially rigid insulating material and laminated thereto a relatively thin surface of wood, aluminum, steel, plastic, etc. With an inner core of foam concrete or solid precast concrete it may be preferred not to use an outer skin or laminate, or it may be laminated with lath, foam polystyrene, plaster, etc.

In assembling these panels into wall sections, linearly grooved pillars or posts are positioned and fixed vertically with the panels inserted into the grooves which are designed to have their width of the same dimension as the overall thickness of the panels. In this way the panels are assembled in an upright position and held tightly and securely. Each panel has a substantial length so that only one panel or no more than two panels are generally sufficient to fill the full length of said linear groove. The grooved pillars may be of any desired material such as aluminum, steel, concrete, etc. but for most purposes are preferably made of wood. Similar structures are used for roofing except that grooved joists at appropriate angles are used in place of the grooved pillars.

This type of structure is particularly suitable for including windows and doors in the wall sections. These are constructed by using wood splines as inserts in the vertical grooves to provide the vertical sections of a window frame or door frame and grooved joists are used above and below a window to provide the top and bottom of the window frame or above a door to provide the top of a door frame. In each case the other groove in the grooved joist is turned toward and fitted over the edge of an adjacent panel.

Further description of the paneling, grooved pillars and other structures of this invention may be facilitated by reference to the drawings.

DETAILED DESCRIPTION

Figures 1, 2, 3, 4, 12, 13, 14, 15, 16:
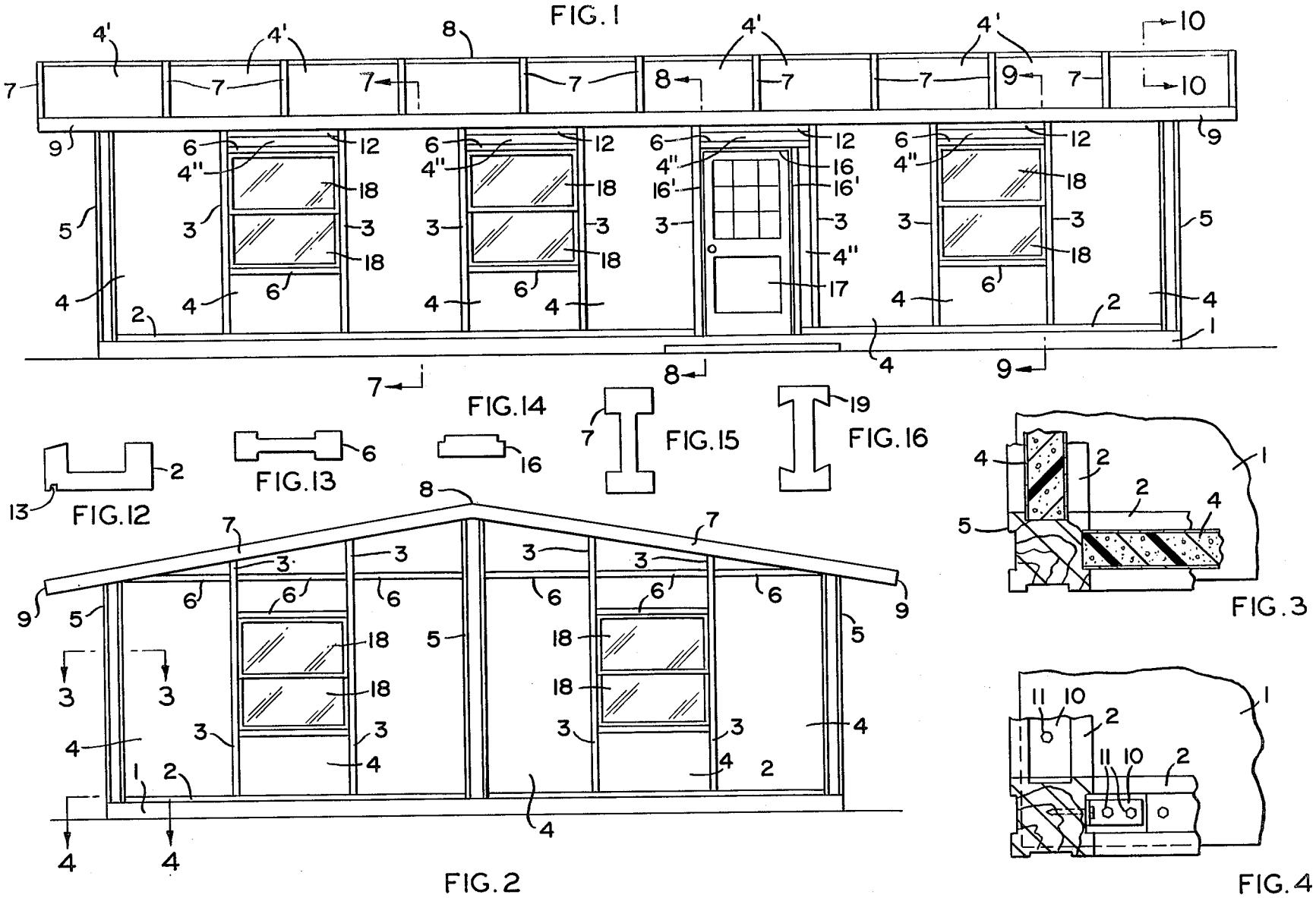
FIG. 1 is a front elevational view of a single story house made using the structural materials of this invention.
FIG. 2 is a side elevational view of the same house.
FIG. 3 is a cross-sectional horizontal view of a corner structure of the house taken at line 3—3 of FIG. 2.
FIG. 4 is a cross-sectional horizontal view of the same corner taken at floor level at line 4—4 of FIG. 2.
FIG. 12 is a grooved joist or plate having a single groove and having one side slanted and is also shown positioned at the top of a wall section in FIG. 9.
FIG. 13 is an end view of a grooved pillar or stud having two grooves on opposite faces.
FIG. 14 is an end view of a spline which will fit into a groove such as in FIG. 13 to form a door jamb or window frame.
FIGS. 15 and 16 are the end view of I-beams or beam studs having grooves into which panels may be fitted.

In FIGS. 1 and 2 a concrete or wooden floor or base 1 may be used to support the house. Horizontal singly grooved joist or plate 2 is laid on the base and doubly grooved pillars 3 rest on horizontal joist or plate 2 and extend vertically upward. Pillars 3 may be prefastened to joist 2 before the panels 4 are placed in position, in which case the panels are inserted into the grooves in the pillars by raising the panels above the top end of the pillars and allowing the panels to slide downward with the vertical edges in the grooves of the pillars. Alternatively, the individual pillars may be positioned after each panel is positioned, followed by the positioning and fastening of an adjacent pillar. These panels and pillars are each in most cases of standard sizes and may be used interchangeably with other panels or pillars. A typical standard panel size is 8 feet long, 4 feet wide and 3 inches thick for panels having a polystyrene core of $2\frac{1}{2}$ – $2\frac{5}{8}$ inches and two sheet wood laminates of three-sixteenths–one-fourth inch each. Standard pillars have an overall cross-sectional dimension of $5\frac{1}{2} \times 2\frac{1}{2}$ to $5\frac{1}{2}$ inches with 1, 2, 3 or 4 grooves therein each of 3 inches wide and ½ to 1¼ inch depth.

Columns or posts 5 are used at the corners and in the center of the side wall to give greater support to the roof. These posts also have grooves therein at the appropriate place to receive the vertical edge of the panels placed next to them. In the corner posts these grooves are in two adjacent faces of the post, and in the center posts the grooves are in two opposite faces. At the top of each standard size panel 4 there is a horizontal joist 6 having a groove on its lower side to accommodate insertion of the top edge of panel 4 and on its upper side it has a groove to accommodate the lower edge of panel 4'. Panels 4' have different shapes and sizes to accommodate the wall area between joists 6 and the roof.

The roof comprises a number of parallel joists 7 shown in a slanted position in FIG. 2. Each joist 7, except the end joists have two grooves therein, on opposite sides to receive the panel sections 4'. Each panel preferably extends the full length of the roof from the peak 8 to the front or back edge 9 of the roof.

The corner structure of the house as shown in FIG. 3 has a post having four grooves therein with two of the grooves on adjacent faces having panels 4 inserted therein.

In the corner structure at floor level shown in FIG. 4 the corner post 5 is firmly fastened to floor joists or plates 2 by brackets 10 which are held by bolts, nails or screws 11. These are fastened before the panels are inserted.

Figure 5:
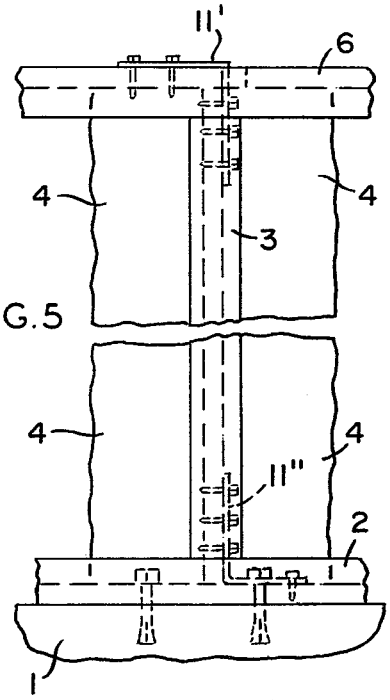
FIG. 5 is a side view showing the insertion of panels into a grooved pillar having grooves on opposite sides of the pillar, as well as top and bottom plates into which the panels are inserted into single grooves in the plates.

FIG. 5 also illustrates how the grooved pillars 3 are fastened to top joist 6 and base plate 2 by brackets 11' and 11'' respectively.

Figure 6:
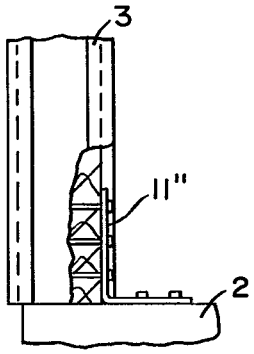
FIG. 6 shows the manner in which a pillar or stud may be fastened or bracketed to the floor.

FIG. 6 is another view showing the fastening of grooved pillar 3 to base plate 2 by bracket 11''.

Figure 7:
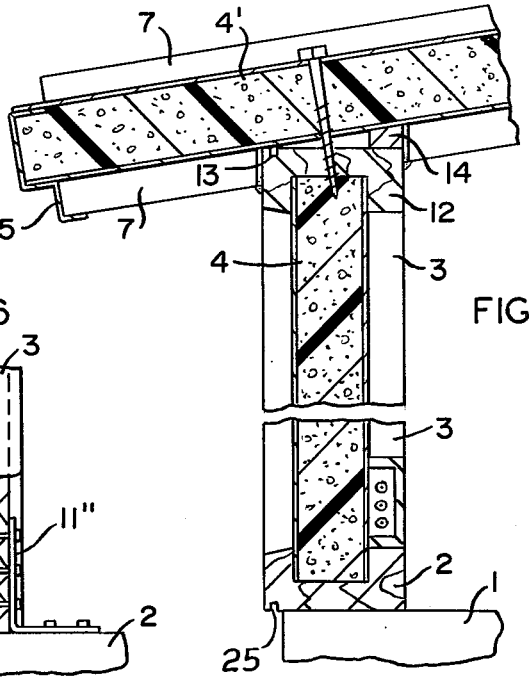
FIG. 7 shows the manner of joining a roof section and a wall section by a sectional view at 7—7 of FIG. 1.

In FIG. 7 a wall section is shown supporting a portion of a roof section. Base plate 2 forms the bottom of the wall with wall panel 4 supported by having its edges inserted into grooves in plate 2, pillar 3 and upper plate 12. Upper plate 12 is illustrated in FIG. 12 with an opening 13 which serves as a waterstop to prevent external water from penetrating. Shim 14 is positioned above top plate 12 to give additional support to the slanted roof panel which comprises grooved joist 7 or beam 20 and roof panel 4'. Bracket 15 is shaped to embrace the end of panel 4' and part of the end of joist 7 to protect the otherwise exposed end of the panel from drainage. This bracket may be made of aluminum, coated steel, plastic, etc. to withstand weathering, and a gutter may be installed thereon. The bottom of base plate 2 has a lip 25 designed to prevent water which runs down the side of the wall from running under the plate. This lip increases the tendency of the water to drop off the edge of the base plate.

Figure 8:
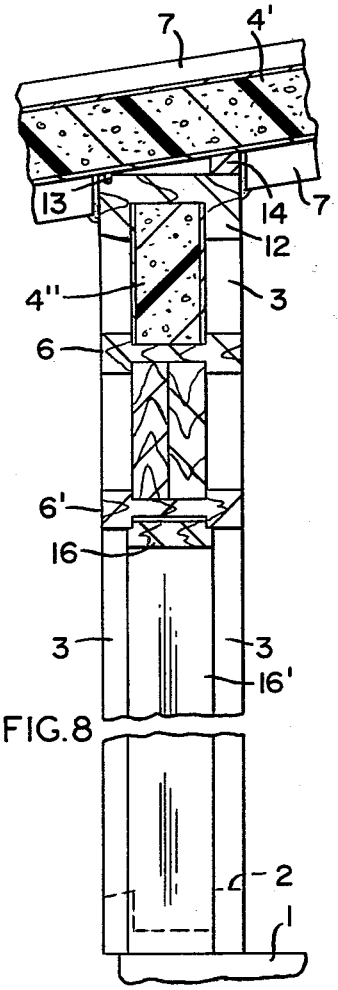
FIG. 8 is a cross-sectional vertical view of the door jamb structure taken at line 8—8 of FIG. 1.

The section in FIG. 8 illustrates the structure of the door frame taken at line 8—8 in FIG. 1. Pillars 3 form a standard section into which standard sizes of panel are usually inserted. However in forming a door frame a spline 16' is inserted in the groove of the pillar 3 against which the door will open and close. Joist 6' supports the upper part of the door frame with spline 16 inserted in the lower groove of joint 6' to form the top of the door frame. Another joist 6 is positioned above and parallel to joist 6' with two boards positioned between and in the facing grooves of said joists 6' and 6 to serve as structural headers. The upper groove in said groove 6 is fitted with a panel 4'' of appropriate size. In order to accommodate the desired door jamb size in a standard size panel space, the pillar 3 adjacent to the hinged side of the door is fitted with a narrow strip of panel 4'' of appropriate width to fill the space between pillar 3 and pillar 3' which will hold in the opposite groove vertical spline 16'' of the door jamb.

Figure 9:
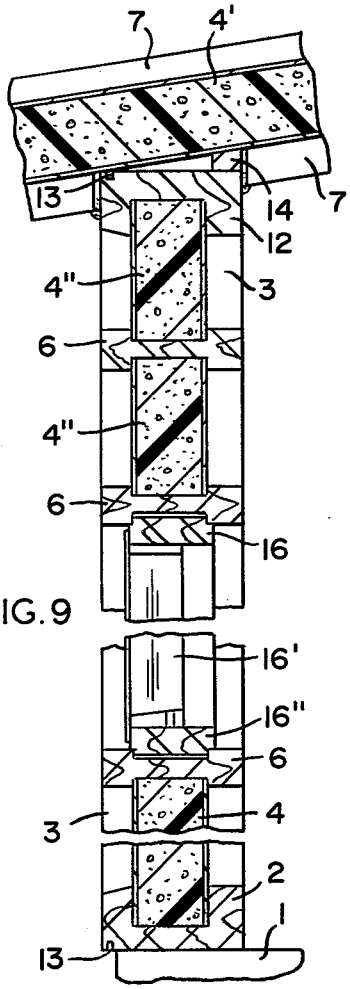
FIG. 9 is a cross-sectional vertical view of a window frame taken at line 9—9 of FIG. 1.

In FIG. 9 the window frame structure is illustrated as taken at line 9—9 of FIG. 1. In this case the window casements are Below the windows 18 there is a wall section of appropriate height made from panel 4 inserted in the facing grooves of the two pillars 3 and framed on the top by joist 6. The window frame is formed by inserting splines 16, 16' and 16'' in the facing grooves of top joist 6, pillars 3 and bottom joist 6 respectively.

Figure 10:
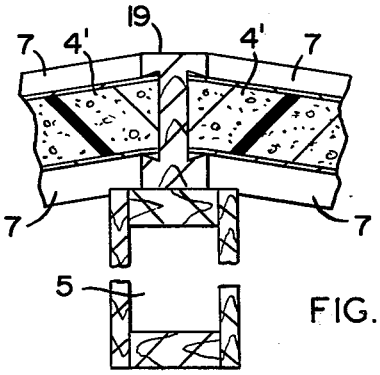
FIG. 10 is a cross-sectional vertical view of a roof section taken at line 10—10 of FIG. 1.
Figure 17:
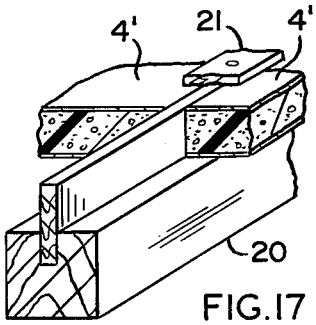
FIG. 17 shows a joist or modified I-beam in which the bottom portion 20 is much thicker than the top portion 21, and panel 4' is held in the grooves between these two portions. This may be desired where greater strength is desired in a roof joist or to satisfy aesthetic requirements.

FIG. 10 illustrates the manner of joining the panels and joists at the peak of the roof. Beam 19 in cross-section is shaped in the form of an I with receding inner edges as shown. This beam preferably extends the length of the house. The roof panels 4' fit into the grooves of the I shaped beam and the ends of the roof joists 7 abut into very close fitting contact with the top and bottom side edges of the I beam. This I-beam 19 rests on supporting post 5 as shown more closely in FIG. 2.

Figure 11:
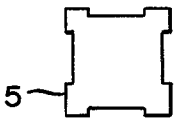
FIG. 11 is the end view of a grooved column or pillar having a groove on each of its four sides.

FIG. 11 is the end view of a pillar or post having four grooves which may be used in the interior of a building where the corners of four rooms abut each other so that the four grooves may be used to support panels forming four walls. Such a post or pillar may also be used to form an interior or exterior section where three walls abut or even to form a corner section where only two walls abut in which cases only the desired number of grooves will be occupied with panels to form the desired arrangement, for example as shown in FIGS. 3 and 4.

As described above the various pillars and joists with one or more faces thereof having a linear groove as shown herein may be easily assembled with the panels described to construct the house shown in FIGS. 1 and 2.

As previously indicated one of the particular advantages of the structure of this invention is the ease with which openings such as windows and doors can be included in the structure. Other advantages include ease of construction and assembly, sturdiness of construction, trimming capabilities, etc.

The invention accordingly comprises the features of construction, combination of elements and arrangements of parts which will be exemplified in the construction hereinafter set forth, and the scope of the invention will be indicated in the claims.

What is claimed is:

1. Prefabricated structural materials, comprising in combination:

a plurality of panels each having an inner core of an insulating material interposed between two sheet materials laminated to said inner core;

said inner core of insulating material being at least a major portion of the thickness of said panel;

a plurality of supporting pillars each having one or more linear grooves therein of an appropriate width and depth to embrace and hold the edge portions of said panels;

first means establishing said plurality of pillars to be spaced relative to adjacent pillars such that the distance between the bases of facing grooves of adjacent pillars is commensurate with the width of said panel;

a plurality of joists each having one or more linear grooves therein of an appropriate width and depth to embrace and hold the edge portions of said panels;

said plurality of joists being spaced relative to adjacent joists such that the distance between the bases of facing groove of adjacent joists is commensurate with the length of said panels;

said plurality of panels being insertable into adjacent facing grooves of said pillars and joists to form a building structure;

window means including a plurality of window joists extending between first selected adjacent pillars;

said window means including a plurality of window splines cooperating with said grooves of said window joists and said first selected adjacent pillars;

door means including a door joist extending between second selected adjacent pillars; and said door means including a plurality of door splines cooperating with said grooves of said door joist and said second selected adjacent pillars.

2. Prefabricated structure as set forth in claim 1, wherein said first means includes a base joist having a single groove facing upwardly for receiving the bottom edges of said plurality of panels; and means including bracket means for securing said plurality of pillars to said base joist.

3. Prefabricated structure as set forth in claim 2, wherein said base joist includes a water stop for preventing external water from penetrating under said base joist.

4. Prefabricated structural materials as set forth in claim 1, wherein said door means includes at least one of said door splines being spaced by door panel means from one of said selected adjacent pillars to establish said door splines at a distance to accommodate a standard size door.

5. Prefabricated structural materials as set forth in claim 4, wherein said door means includes a first and a second door joist;

said first door joist being immediately adjacent said door spline with said second door joist being established parallel to said first door joist; and support means established in adjacent facing grooves of said first and second door joists to form a structural header.

6. Prefabricated structural materials as set forth in claim 1, wherein said window means includes a first and a second window panel respectively spacing said window joists relative to one another to establish said door spline at a distance to accommodate a standard size window.

7. Prefabricated structural materials as set forth in claim 1, including an upper plate having a groove for receiving the upper edge portions of said plurality of panels.

8. Prefabricated structural materials as set forth in claim 7, wherein said plurality of joists includes roof joists, and shim means for supporting said plurality of roof joist relative to said upper plate.

9. Prefabricated structural materials as set forth in claim 7, wherein said upper plate includes a water stop for preventing external water from penetrating under said upper plate.

10. The structural materials of claim 1 in which said inner cores of said panels comprise foam polystyrene.

11. The structural materials of claim 10 in which said laminated sheet material is wood.

12. The structural materials of claim 11 in which said pillars and joists comprise wood.

13. The structural materials of claim 1 in which said panels have inner cores comprising fiberglass.

14. The structural materials of claim 1 in which said panels have inner cores comprising foam concrete and said pillars and said joists comprise precasted reinforced concrete.

* * * * *

UNITED STATES PATENT OFFICE

CERTIFICATE OF CORRECTION

Patent No. 4,071,984 Dated February 7, 1978

Inventor(s) Kenneth Larrow

It is certified that error appears in the above-identified patent and that said Letters Patent are hereby corrected as shown below:

Column 1, line 13, "joints" should be -- joists --.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*